US005590384A

United States Patent [19]

Reinshagen

[11] Patent Number: 5,590,384

[45] Date of Patent: Dec. 31, 1996

[54] PROCESS FOR IMPROVING THE CORROSION RESISTANCE OF STAINLESS STEEL POWDER COMPOSITION

[75] Inventor: John H. Reinshagen, North Huntindton, Pa.

[73] Assignee: Ametek, Specialty Metal Products Division, Eighty Four, Pa.

[21] Appl. No.: 565,590

[22] Filed: Nov. 30, 1995

Related U.S. Application Data

[62] Division of Ser. No. 413,126, Mar. 28, 1995, Pat. No. 5,529,604.

[51] Int. Cl.[6] ..... B22F 1/00; B22F 7/00

[52] U.S. Cl. ..... 419/6; 419/38

[58] Field of Search ..... 419/38, 6

[56] References Cited

U.S. PATENT DOCUMENTS

| | | | |
|---|---|---|---|
| 3,425,813 | 2/1969 | Orlemann | 428/570 |
| 3,520,680 | 7/1970 | Orlemann | 419/35 |
| 4,240,831 | 12/1980 | Ro et al. | 75/228 |
| 4,314,849 | 2/1982 | Ro et al. | 75/228 |
| 4,420,336 | 12/1983 | Klar et al. | 75/246 |
| 4,662,939 | 5/1987 | Reinshagen | 75/246 |

OTHER PUBLICATIONS

Chatterjee, S. K. et al; The Effect of Tin, Copper, Nickel and Molybdenum on the Mechanical properties and Corrosion Resistance of Sintered Stainless Steel (AISI 304L). Mod. Dev. Powder Metall. (1985) vol. Date 1984, 16, 277–93.

*Primary Examiner*—Ngoclan Mai

*Attorney, Agent, or Firm*—Bachman & LaPointe, P.C.

[57] ABSTRACT

The present invention related to a process for improving the corrosion resistance and processability of stainless steel powder composition. The process comprises prealloying the stainless steel powder with about 1% to about 3% by weight of tin and blending the prealloyed stainless steel powder before molding with from about 0.5% to about 1.5% of an additive in particulate form consisting essentially of by weight 2 to 30% of tin and the balance consisting essentially of at least one element selected from copper and nickel.

11 Claims, No Drawings

PROCESS FOR IMPROVING THE CORROSION RESISTANCE OF STAINLESS STEEL POWDER COMPOSITION

This is a Division, of patent application Ser. No. 08/413,126, filed Mar. 28, 1995, U.S. Pat. No. 5,529,604.

BACKGROUND OF THE INVENTION

The present invention relates to modified stainless steel powders and compacts formed therefrom, and more particularly to improving the processability of such powders and compacts and improving corrosion resistance properties.

It is known in the art that the corrosion resistance of stainless steel powders can be improved by making tin additions to the stainless steel powders. U.S. Pat. No. 4,240,831 to Ro et al. teaches a process for improving the corrosion resistance of stainless steel powders through the addition of an effective proportion of a modifier metal selected from the group consisting of tin, aluminum, lead, zinc, magnesium, rare earth metals and like metals.

U.S. Pat. No. 4,314,849 to Ro et al. also teaches that the corrosion resistance of stainless steel powder compacts can be improved if they contain tin and silicon. Ro et al. aver that the corrosion resistance can be maximized if compacts formed from such modified stainless steel powders are sintered at temperatures in excess of 2300° F. in highly reductive atmospheres until the ratio of Sn:Si on the surface of the compact is at least about 1:1. U.S. Pat. No. 4,420,336 to Klar et al. relates to a foraminous body having improved corrosion resistance to aqueous nitric acid. The foraminous body is formed of tin-containing water atomized, compacted and sintered austenitic stainless steel alloy powder compacted and sintered to less than 80% of theoretical density. It is also formed of a prealloyed stainless steel alloy powder containing from 0.1% to 10% by weight tin and, optionally, from 0.5% to 5% copper.

U.S. Pat. No. 4,662,939 to Reinshagen, assigned to the assignee of the present invention, teaches that the corrosion resistance of stainless steel powder moldings can be improved by combining the powder before molding with about 8% to 16% by weight of an additive consisting essentially of about 2 to 30% by weight of tin and 98 to 70% by weight of copper and/or nickel. It has been found in practice that parts manufactured from this composition, while demonstrating excellent corrosion resistance properties, grow on sintering. As a result, these parts have limited acceptance since they typically do not meet required dimensional tolerances. Parts manufactured from stainless steel powders which exhibit improved corrosion resistance and which are capable of meeting required dimensional tolerances are in demand.

SUMMARY OF THE INVENTION

Accordingly, it is an object of the present invention to provide a modified stainless steel composition having improved processability.

It is a further object of the present invention to provide a modified stainless steel composition as above having excellent corrosion resistance properties.

It is yet a further object of the present invention to provide a process for forming a modified stainless steel composition having improved processability and excellent corrosion resistance properties.

The foregoing objects are met by the modified stainless steel composition of the present invention which comprises stainless steel powder prealloyed with from about 1% to about 3% by weight tin, and blended with from about 0.5% to about 1.5% by weight of a prealloyed powder additive consisting essentially of from about 2% to about 30% by weight tin and the balance consisting essentially of at least one element selected from copper and nickel. In a preferred embodiment, the additive has a nominal composition of about 7–9% by weight tin, about 14–16% by weight nickel, and the balance essentially copper. The base stainless steel composition prior to alloying with tin and blending with the additive may be austenitic stainless steel, such as 303L, 304L or 316L, or the ferritic, martensitic or precipitation hardening grades.

The process for forming the modified stainless steel composition of the present invention comprises the steps of: alloying the stainless steel powder with about 1% to about 3% by weight tin added to the melt prior to atomization and thereafter blending the tin modified powder alloy with from about 0.5% to about 1.5% by weight of said aforementioned additive.

After the modified stainless steel composition of the present invention is manufactured, it may be compacted and sintered.

Other details of, and objects and advantages to, the modified stainless steel compositions of the present invention and the process of forming them are set forth in the following detailed description.

DETAILED DESCRIPTION OF THE PREFERRED EMBODIMENT(S)

As previously mentioned, the modified stainless steels of the present invention have a composition consisting essentially of from about 1% to about 3% by weight tin, prealloyed with the stainless steel powder and from about 0.5% to about 1.5% by weight of a prealloyed powder additive consisting essentially of from about 2% to about 30% by weight tin and the balance consisting essentially of at least one element selected from copper and nickel. The powder additive preferably has a particle size of 500 mesh or finer. In a preferred embodiment of the present invention, the additive has a nominal composition consisting essentially of about 7–9% by weight tin, about 14–16% nickel and the balance essentially copper. The base stainless steel composition, prior to alloying with tin and blending with the additive may be austenitic stainless steel, such as 303L, 304L or 316L, or the ferritic, martensitic or precipitation hardening grades.

The modified stainless steel compositions of the present invention are manufactured by water atomization of a melt of stainless steel of the appropriate grade to which from about 1% to about 3% by weight tin is added prior to atomization. Thereafter, the atomized powder composition is blended with from about 0.5% to about 1.5% by weight of the aforementioned additive, also preferably in a particulate form such as powder. The blending may be carried out using any suitable conventional blending method known in the powder metallurgy art, such as using a double cone blender or a vee blender.

It is generally desirable to add a small quantity of a lubricant to the molding composition to protect the dies and to facilitate removal of the compacted specimen. Usually, from about 0.25% to about 1.5% by weight of a lubricant is added. Typical lubricants are lithium stearate, zinc stearate, Acrawax C, or other waxes. The lubricant will typically be added at the blending step.

After blending, the modified stainless steel composition may be compacted using any conventional powder metallurgy compacting technique known in the art and sintered, again using any suitable conventional powder metallurgy technique known in the art. According to a preferred method, the stainless steel powder composition is compacted at high pressure in a mold of desired shape, usually at room temperature and about 5 to 50 tons per square inch pressure. The sintering step preferably comprises sintering the compacted stainless steel powder composition at about 2050° F. to about 2400° F. for about 15 minutes to about an hour. Any suitable atmosphere such as a dissociated ammonia atmosphere may be used during the sintering step.

Various techniques may be used to shape the novel stainless steel powder compositions of the present invention into a desired form. Such molded articles may be made using any standard molding technique known in the art for converting metal powders into coherent aggregates by application of pressure and/or heat. Such techniques include powder rolling, metal powder injection molding, compacting, isostatic pressing and sintering.

Prior to sintering, the compacted material may be heated at a temperature of from about 800° F. to about 1000° F. for about 15 minutes to about one hour to remove the lubricant from the composition, if said lubricant was added.

It has been found that modified stainless steel powder products manufactured in accordance with the present invention exhibit corrosion resistance superior to both standard grades of stainless steel and modified stainless steels prealloyed with 1% by weight tin and 2% by weight copper. It has also been found that modified stainless steel powder products manufactured in accordance with the present invention do not grow on sintering. In fact, the powder products of the present invention tend to shrink on sintering. This is highly desirable because parts processed from the modified stainless steel powders of the present invention are more able to meet desired dimensional tolerances.

To demonstrate the outstanding corrosion resistance properties of the compositions of the present invention, the following examples were performed.

EXAMPLE 1

Four powders based on the austenitic chromium-nickel-iron AISI Type 303L stainless steel were evaluated:

Powder A: Water atomized powder of standard 303L composition.

Powder B: Water atomized powder of standard 303L composition except alloyed with 1.5% tin and blended with 1% by weight of an alloy powder additive. The additive consisted of −500 (25 micrometer) U.S. Standard Sieve mesh size powder of 8% tin, 15% nickel and 77% copper produced by water atomization.

Powder C: The same as Powder B, but blended with 2% by weight of the additive.

Powder D: A commercially available water atomized powder of standard 303L composition except alloyed with nominally 1% tin and 2% copper.

Each of the four powders was blended with 1% by weight Arawax C lubricant, then compacted in the form of Metal Powder Industries Federation (MPIF) transverse rupture strength (TRS) test specimens. Six specimens were produced from each powder employing a compaction pressure of 40 tsi. Following compaction, the lubricant was removed by heating the green compacts in air for 20 minutes at 950° F. The samples were then sintered for 30 minutes at 2100° F. in simulated dissociated ammonia (DA) in a laboratory muffle furnace, then transferred to the water-cooled zone of the furnace and allowed to cool to room temperature.

The samples were tested for corrosion resistance by total immersion in a solution of 5% by weight of sodium chloride in deionized water at room temperature. Corrosion resistance was determined by determining the time required for the test samples to exhibit first corrosion (rust). The test duration was 381 hours.

Table I presents the results. As seen from Table I, Powder B exhibits markedly superior corrosion resistance.

TABLE I

| ID | Description | Time to Exhibit First Corrosion (Hours) Average | Range |
|---|---|---|---|
| A | 303L | 5 | 1–21 |
| B | 303L Alloyed W/Tin + 1% Additive | 165 | 117–189 |
| C | 303L Alloyed W/Tin + 2% Additive | 34 | 4–45 |
| D | 303L Alloyed W/Tin and Copper | 29 | 21–45 |

EXAMPLE 2

Four powders based on the austenitic chromium-nickel-iron AISI Type 304L stainless steel were evaluated:

Powder E: Water atomized powder of standard 304L composition.

Powder F: Water atomized powder of standard 304L composition except alloyed with 1.5% tin, and blended with 1% by weight of an alloy powder additive. The additive consisted of −500 (25 micrometer) U.S. Standard Sieve mesh size powder of 8% tin, 15% nickel and 77% copper produced by water atomization.

Powder G: The same as Powder F, but blended with 2% by weight of the additive.

Powder H: A commercially available water atomized powder of standard 304L composition except alloyed with nominally 1% tin and 2% copper.

Each of the four powders was processed and tested as described in Example 1, except the test duration was 361 hours.

Table II presents the test results. As seen from Table II, Powder F exhibits markedly superior corrosion resistance.

TABLE II

| ID | Description | Time to Exhibit First Corrosion (Hours) Average | Range |
|---|---|---|---|
| E | 304L | 1 | — |
| F | 304L Alloyed W/Tin + 1% Additive | >361* | 61–>361 |
| G | 304L Alloyed W/Tin + 2% Additive | >290** | 30–>361 |
| H | 304L Alloyed W/Tin and Copper | 97 | 2–361 |

*Only 1 of the six samples exhibited rust following 361 hours in test.
**Three of the six samples exhibited rust following 361 hours in test.

For each of the powders produced in Examples 1 and 2, the dimensional change from die size following sintering are as follows:

| Powder ID | Dimension Change From Die Size (%) |
|---|---|
| A | −0.23 |
| B | −0.36 |
| C | +0.13 |
| D | −0.81 |
| E | −0.44 |
| F | −0.39 |
| G | +0.09 |
| H | −0.40 |

It is apparent that there has been provided in accordance with this invention a modified stainless steel powder composition which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed is:

1. A process for improving the corrosion resistance and processability of stainless steel powder compositions which comprises providing a stainless steel powder, prealloying said stainless steel powder with about 1% to about 3% by weight of tin, blending the stainless steel powder before molding with from about 0.5% to about 1.5% of an additive in particulate form consisting essentially of by weight 2 to 30% of tin and the balance consisting essentially of at least one element selected from copper and nickel.

2. The process of claim 1 wherein said stainless steel is an austenitic stainless steel.

3. The process of claim 1 wherein said stainless steel is stainless steel 303L.

4. The process of claim 1 wherein said stainless steel is stainless steel 304L.

5. The process of claim 1 wherein said stainless steel is stainless steel 316L.

6. The process of claim 1 wherein said stainless steel is martensitic stainless steel.

7. The process of claim 1 wherein said stainless steel is ferritic stainless steel.

8. The process of claim 1 wherein said stainless steel is precipitation hardening stainless steel.

9. The process of claim 1 wherein said additive has a nominal composition consisting essentially of about 7–9% by weight tin, about 14–16% nickel, and the balance essentially copper.

10. The process of claim 1 further comprising compacting said blended stainless steel powder and additive at high pressure and heating said compact to sintering temperature.

11. The process of claim 1 wherein said additive is comprised of particles having a size of 500 mesh or finer.

* * * * *